US008640388B2

(12) United States Patent
Favell

(10) Patent No.: US 8,640,388 B2
(45) Date of Patent: Feb. 4, 2014

(54) ROSTRUM AND SUPPORT STRUCTURE

(75) Inventor: Giles Favell, London (GB)

(73) Assignee: Steeldeck Industries Limited (GB)

( * ) Notice: Subject to any disclaimer, the term of this patent is extended or adjusted under 35 U.S.C. 154(b) by 28 days.

(21) Appl. No.: 12/663,588

(22) PCT Filed: Jun. 3, 2008

(86) PCT No.: PCT/GB2008/001889
§ 371 (c)(1),
(2), (4) Date: Mar. 22, 2010

(87) PCT Pub. No.: WO2008/149077
PCT Pub. Date: Dec. 11, 2008

(65) Prior Publication Data

US 2010/0180515 A1 Jul. 22, 2010

(30) Foreign Application Priority Data

Jun. 8, 2007 (GB) ..... 0711106.5
Jun. 12, 2007 (GB) ..... 0711330.1

(51) Int. Cl.
*E04H 3/28* (2006.01)

(52) U.S. Cl.
USPC ..... 52/7; 52/8; 52/118

(58) Field of Classification Search
USPC ..... 52/6–10, 64, 67, 71, 182–184, 191, 52/637–638, 645–646, 648.1, 118, 121, 52/632
See application file for complete search history.

(56) References Cited

U.S. PATENT DOCUMENTS 1,839,410 A 4/1929 Post
1,839,679 A 12/1930 Hoppes
2,503,363 A * 4/1950 Torkelson ..... 52/8

(Continued)

FOREIGN PATENT DOCUMENTS

DE 217 697 C 1/1910
DE 217697 1/1910

(Continued)

OTHER PUBLICATIONS

Notification Concerning Transmittal of International Preliminary Report on Patentability dated Dec. 23, 2009, International Preliminary Report on Patentability and Written Opinion of the International Search Authority in corresponding patent PCT/GB2008/001889, 4 pages total.

(Continued)

*Primary Examiner* — Brian Glessner
*Assistant Examiner* — Beth Stephan
(74) *Attorney, Agent, or Firm* — Ostrolenk Faber LLP

(57) ABSTRACT

A support structure for a rostrum includes a first A-frame; and at least a second A-frame, nestable and retractable into the first A-frame. The support structure may have an open central area and the second A-frame may be substantially the same as, but smaller than, the open central area of the first A-frame. At least one support means is connected to each A-frame for supporting a load, wherein the support is connected to an upper portion of one A-frame. The support extends from the upper portion of the one A-frame and is co-operable with an upper portion of another A-frame. The support structure may be telescopic and configured to be expandable and retractable between a retracted, stored position, and an extended, in use position.

14 Claims, 3 Drawing Sheets

(56) References Cited

U.S. PATENT DOCUMENTS

| | | | | |
|---|---|---|---|---|
| 2,724,150 | A | 11/1955 | Lublin | |
| 3,400,502 | A | 9/1968 | Scaggs et al. | |
| 3,488,898 | A | 1/1970 | Scaggs | |
| 4,490,949 | A | 1/1985 | Sutter et al. | |
| 4,590,720 | A * | 5/1986 | Reed | 52/121 |
| 4,747,238 | A * | 5/1988 | Wikstrom et al. | 52/8 |
| 4,908,999 | A * | 3/1990 | Harris | 52/8 |
| 4,926,590 | A * | 5/1990 | Harris | 52/8 |
| 5,069,007 | A * | 12/1991 | Paddock | 52/9 |
| 5,277,001 | A | 1/1994 | Bryant | |
| 5,517,789 | A | 5/1996 | Sugiyama | |
| 5,559,411 | A | 9/1996 | Winship | |
| 5,819,475 | A | 10/1998 | Momose | |
| 6,000,174 | A | 12/1999 | Yamazaki | |
| 6,055,780 | A | 5/2000 | Yamazaki | |
| 6,199,325 | B1 | 3/2001 | Winship | |
| 6,244,657 | B1 | 6/2001 | Momose | |
| 6,539,672 | B1 * | 4/2003 | Frost | 52/9 |
| 6,574,923 | B1 * | 6/2003 | Johnsson et al. | 52/8 |
| 6,676,333 | B2 * | 1/2004 | Wiseman et al. | 405/114 |
| 7,574,832 | B1 * | 8/2009 | Lieberman | 52/118 |
| 2007/0296253 | A1 | 12/2007 | Conner | |

FOREIGN PATENT DOCUMENTS

| | | |
|---|---|---|
| EP | 0 291 275 | 11/1988 |
| EP | 0 510 845 | 10/1992 |
| FR | 717042 | 12/1931 |
| FR | 936306 | 7/1948 |
| GB | 976192 | 11/1964 |
| GB | 2 241 883 | 9/1991 |
| GB | 2 257 169 | 1/1993 |
| JP | 60-55638 | 4/1985 |
| WO | WO 89/01084 | 2/1989 |
| WO | WO 99/36645 | 7/1999 |
| WO | WO 01/06894 | 2/2001 |

OTHER PUBLICATIONS

International Search Report dated Feb. 18, 2009, issued in corresponding international application No. PCT/GB2008/001889.

* cited by examiner

ROSTRUM AND SUPPORT STRUCTURE

CROSS REFERENCE TO RELATED APPLICATIONS

The present application is a 35 U.S.C. §371 National Phase conversion of PCT/GB2008/001889, filed Jun. 3, 2008, which claims benefit of British Application Nos. 0711106.5, filed Jun. 8, 2007 and 0711330.1, filed Jun. 12, 2007, the disclosures of which are incorporated herein by reference. The PCT International Application was published in the English language.

BACKGROUND OF THE INVENTION

This invention relates to a support structure for a rostrum and particularly, but not exclusively, to a plurality of collapsible and expandable support structures arranged such that a deck can rest upon the supports to create a rostrum. This invention also relates to a rostrum comprising a deck supported by two or more of said support structures.

Support structures are used to provide a secure stand or base on which to locate a raised deck, platform, stage or similar base on which a seating structure can be arranged, thus creating a tiered structure, or auditorium, such as those often found at concerts and outdoor events. Examples of known support structures on which a raised deck may rest can be grouped into different types.

DE 217,697 or U.S. Pat. No. 2,724,150 can represent a first group of known support structures used in configuring a rostrum, wherein a number of supports are arranged to support an inclined deck on which a seating arrangement rests. The rostrum disclosed in DE 217,697 is a complex assembly, comprising a number of individual components, which requires labour intensive manual assembly. Although such rostrum arrangements are advantageous because they are suitable for compact storage and are easily transported, they can be unstable during the assembly process.

A second group of known rostrum arrangements is represented by U.S. Pat. No. 3,400,502, in which a single unit comprising a number of individual nested units can be expanded and retracted. U.S. Pat. No. 3,400,502 discloses a tiered rostrum, in which each tier is formed of a C-shaped support frame and a deck. Each deck is configured upon a common chassis and cooperates with neighbouring tiers to be expandable and retractable from said common chassis.

Rostra created from nested systems, as disclosed in U.S. Pat. No. 3,400,502, overcome the problem of labour intensive assembly by being pre-assembled structures. Being comprised of one single unit, there is an increase in stability during assembly between each of the tiers of the rostrum because each tier is inter-connected to the others within the rostrum structure.

Although nested systems overcome the problem of rostra comprising individual components, nested systems often require a permanently fixed deck to maintain the stability of the frame, to prevent the frame flexing or distorting during extension or retraction. Moreover, a single nested unit requires level and stable ground on which to be installed, otherwise the nested unit is prone to instability when resting upon uneven surfaces. Being formed of one single unit, nested systems are often large, heavy and are unsuitable for compact storage and are difficult to transport.

SUMMARY OF THE INVENTION

It is against this background that the present invention has been made. This invention results from efforts to overcome the problems of known rostrum support structures. Other aims of the invention will be apparent from the following description.

Accordingly, the invention resides in a support structure for a rostrum, comprising: a first A-frame; and at least a second A-frame, nestable and retractable into the first A-frame.

Each support structure provides a more stable structure than known nested assemblies and is inherently stable, in an extended position, without relying on the decking to provide further support or increased rigidity. The support structure can distribute the load, by being interconnected, across a greater floor surface area and is, therefore, less susceptible to irregularities in the floor surface than conventional nested systems. Further, the distribution of the load across a wider area reduces the likelihood of damage to the floor surface.

Each support structure can be completed, assembled and commissioned off-site and can be brought to the location in which the rostrum is to be assembled more easily than conventional nested systems because it is modular. Also, the modular nature of each support structure allows each support structure to be turned at an angle, with respect to other support structures, thus enabling at least two suitably arranged support structures to be arranged to support a curved deck.

The first A-frame may have an open central area, and the second A-frame may have a shape substantially the same as, but smaller than, the open central area of the first A-frame.

The support structure may further comprise at least one support means connected to each A-frame for supporting a load, wherein the support means is connected to an upper portion of one A-frame, the support means extending from the upper portion of the one A-frame and being co-operable with an upper portion of another A-frame.

In the extended position, the support structure may be self-supportingly rigid. The A-frame of each support means may be configured to be vertical, inclined at an angle or adjustable, with respect to the surface on which the support means rests.

The support structure may be telescopic and configured to be expandable and retractable between a retracted, stored position, and an extended, in use position.

Each A-frame may further comprise a foot arranged at the bottom of each limb of the or each A-frame for supporting each A-frame in an upright position. Each foot of each A-frame may be nestable and retractable between the feet and/or limbs the first A-frame.

Each foot of the support structure may comprise wheels or other such means to facilitate the extension and retraction of the support structure. The support structure may optionally comprise manually operated and/or powered-mechanical means for assisting in the extension and retraction of the support structure, which may comprise a system of pulleys, worm gears, hydraulics, pneumatics and/or electric motors.

The support structure may comprise stop means configured to control movement of the A-frame, thus preventing one A-frame from being moved beyond the end of the support means of another A-frame.

Each support means may be independently adjustable in height and/or angle, with respect to the surface on which the support means rests to increase flexibility in use.

In another aspect, the invention resides in a rostrum, comprising at least two of the aforementioned support structures; when extended from their nested and retracted position each support structure is configured to support a deck between the A-frames. The rostrum may comprise at least two or at least three support structures arranged such that the support structures can support a curved deck.

In the extended position, a load imposed by a deck may be distributed between the A-frames of the support structure through the support means.

Thus there is provided a system of retracting rostra or auditoria, as seen in many sports-halls and theatres. This system is based on nests of A-frames for support, instead of the more usual braced C-frames. Each nest consists of a number of A-frames onto which are bolted the decks to form the floor of each tier. These will then pull out (extend) either manually, or by power, to form a stepped (or tiered) stage or auditoria. Stops fixed to the runners dictate the distance each tier is extended, and then pulls out the following tier. This system can be used with or without seats, built with any number of tiers, with rise heights as desired.

Particular advantages of the present invention are as follows:

- Each A-frame support is inherently stable (and not relying on the decking for any support).
- The A-frames distribute the load to the floor over a greater area than conventional systems.
- The A-frames are less susceptible to any irregularities in the floor surface than conventional systems.
- The A-frames conduct the loads imposed by its neighbouring decks much more directly than conventional systems.
- It is easy to construct curved auditoria by either extending the A-frames or skewing them on their runners.
- The nests are completed, assembled and commissioned off site, and brought to site as finished units onto which the decks are simply bolted. This significantly reduces installation times, and even enables retractable auditoria to be available for hire, due to the ease of assembly.
- No other guide mechanism is necessary, as the stops have a second function as guides, ensuring that the frames run out square.

In order that the invention is more readily understood, reference will now be made, by way of example, to the drawings in which:

DESCRIPTION OF PREFERRED EMBODIMENTS

Figure 1:
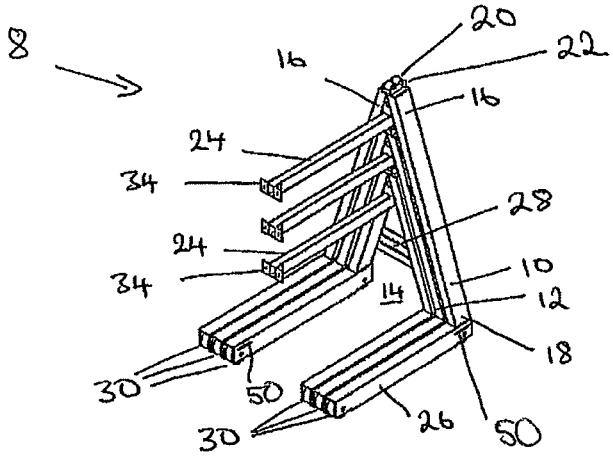
FIG. 1 is a perspective view of an embodiment of the invention comprising a support structure, comprising three A-frames in a retracted and nested condition.

Referring to FIG. 1 of the drawings, a support structure is shown comprising a principal, or first A-frame 10, and two smaller A-frames 12 nested in the open central area 14 within the principal A-frame 10. When two A-frames are being described, the larger A-frame 10 is referred to as the first A-frame 10 and the smaller A-frame 12 is referred to as the second A-frame 12.

Each A-frame 10,12 comprises two upright limbs 16, each limb 16 being spaced apart at a lower portion 18 and connected to one another at an upper portion 20. The upper portion 20 includes an apex 22, with an open central area 14 beneath said upper portion 20. From the upper portion 20, referred to hereinafter as the apex 22, a support means 24 extends substantially horizontally and transverse to the plane in which the A-frame 10,12 lies. The apex 22 is shown as a pointed apex 22 and comprises wheels or rollers, but may be a flat, hipped-type connection. At the lower portion 18 of each A-frame 10,12, a foot 26 extends outwards from the lower portion 18 of each limb 16 in substantially the same direction as the support means.

In the nested condition, each of the A-frames 10,12 lies in the same vertical plane. In the nested condition, each foot 26 enables the support structure 8 to be self-supporting, and to stand alone without the assistance of any other support. In the embodiment shown, the A-frames 10,12 are reinforced by a brace 28 to fix the limbs 16 of each A-frame 10,12 a predetermined distance apart. Further, guide means 30 in the form of wheels 30 are included to improve the manoeuvrability of the support structures 8. Each support structure 8 can be easily manoeuvred and installed in position, before being expanded for use.

Each of the upright limbs 16 of the A-frames 10,12, support means 24 and feet 26 are constructed of steel box sectional, although they may alternatively be constructed from any such equivalent structural material such as tubular aluminium sections and the like. Each limb 16 is connected up its apex 22 by welding or may be connected using a hinge, bracket or other joining means (not shown). By using a hinge, each A-frame 10,12 could be collapsible as an individual component to enable the support structure 8 to be disassembled from its nested condition.

The support means 24, extending from the upper portion 20 of each A-frame 10,12 does not necessarily have to extend horizontally and may alternatively be configured to extend in a downward, or upward, direction from the apex 22 of the A-frame 10,12. Each A-frame 10,12 does not necessarily have to be arranged perpendicular to the surface on which it rests, and may alternatively be angled away from the perpendicular, by adjustment of the limb 16 position to enable the support structure 8 to be placed on a sloped surface, while continuing to provide a support structure 8 for a level deck 38 to be placed thereupon. Further, each A-frame 10,12 may comprise more than one support means.

Although the embodiment shown in FIG. 1 comprises one foot 26 associated with each limb 16 of each A-frame 10,12 to provide support for the A-frame 10,12 structure many alternative configurations are possible. Each A-frame 10,12, may comprise only a single foot 26. Further, each foot 26 may extend in a different direction from the support means. Each A-frame 10,12 may, alternatively, comprise a number of feet 26 extending from the lower portion 18 of each limb 16 or may even be arranged at a non-perpendicular angle with respect to the limbs 16 of the A-frame 10,12.

In an alternative embodiment (not shown) each A-frame 10,12 is a different size such that the height of each support means 24 can be vertically adjusted, while being configured to allow the A-frames 10,12 of the support structure 8 to be nested.

To reduce material and manufacturing costs, each of the A-frames 10,12 may not comprise a foot 26, thus only becoming stable when at least one of the A-frames 10,12 is drawn out from the nested position, such that at least four of the limbs 16 of the support structure 8 are distributed upon a surface on which the support structure 8 is located.

Figure 2:
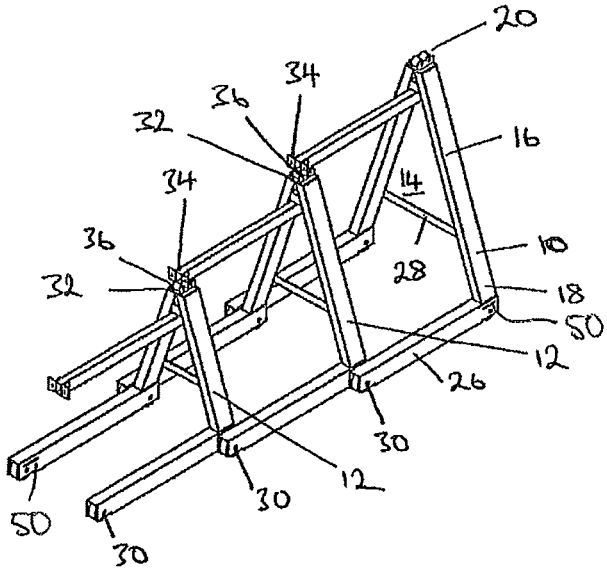
FIG. 2 is a perspective view of the support structure shown in FIG. 1, in an extended position.

FIG. 2 shows the support structure 8 of FIG. 1 in an extended, in use, condition. To extend the support structure 8, each A-frame 10,12 is drawn out from the open central area 14 beneath the upper A-frame 10 is void. The extent to which each A-frame 10,12 slides out is dictated by an interface 32 between the apex 22 of an adjacent A-frame and an end point 34 of each support means. Alternatively, the extent to which each A-frame 10,12 slides out is determined by interacting stops 50 arranged on cooperating outer and inner sides of the feet 26.

By way of example, the A-frame 10 is connected, via the support means, to the apex 22 of the A-frame immediately within the upper A-frame 10. The interface 32 between the support means 24 and the apex 22 of the A-frame 12 is typically a tongue and groove type relationship, known to those skilled in the art. Alternatively, the interface 32 may comprise a wheel or roller assembly on the underside of the support means 24. Therefore, the A-frame 12 will be drawn out from the open central area 14 within the A-frame 10 until the apex 22 of the A-frame 12 reaches the end of the support means 24 of the A-frame 10. At the end of the support means 24 of each A-frame 10 a stop means 36 or barrier is provided to prevent the apex 22 of the A-frame 12 from extending beyond the end of the support means. Each of the smaller, dependent A-frames 12, are drawn out until the support structure 8 is in its fully extended position.

In the extended position, the support means 24 of the A-frame 10 is fixed at one end to the upper portion 20 of the A-frame 10, resting upon and/or connected at the other end to the apex 22 of the A-frame 12, via the interface 32. The relationship of the support means 24 between each A-frame applies, similarly, to each A-frame 10,12 which has a smaller A-frame located there within.

The support means 24 of the smallest A-frame of the support structure 8 is suitably reinforced to bear the weight of a load placed thereupon, or is further supported at its distal end by additional an additional mechanical support (not shown).

The relationship between the apex 22 of the A-frame 12 and the support means 24 above created by the interface 32 is such that the support structure 8 is self-supporting before any deck 38 is placed thereupon. At the same time, the interface 32 allows the support structure 8 and each limb 16 in contact with a surface upon which the support structure 8 rests to be adjusted so that the support structure 8 is stable. The interface 32 allows the support structure 8 to flex in a controlled manner, enabling the support structure 8 to rest onto an undulating surface, and to be secured thereafter. By way of example, the interface 32 may comprise a device analogous to a control device often used at the interface 32 between a tripod and a photographic camera to enable the camera to be positioned at any angle and fixed in position.

The interface 32, typically comprising a tongue and groove type relationship, may comprise additional guide means 30 (not shown in detail) for facilitating the movement of the apex 22 beneath the support means 24 of an A-frame 10. To facilitate the expansion and retraction of each of the A-frames 10,12 from the nested position, materials with low-friction or lubricating properties may be used.

Stop means 36 configured to prevent the apex 22 of the A-frame 12 from extending beyond the end of the support means 24 may be provided by a latch-type system (not shown), which would comprise a mechanism analogous to a slider mechanism of a seat typically found in an automotive vehicle. Such a latch-type mechanism enables a user to control the amount by which an A-frame 12 can be extracted from the nested support structure 8, thus increasing the flexibility of the support structure 8. The stop means 36 may be integrated with the A-frame 10,12, support means 24 and/or the feet 26. Alternatively, latch type mechanisms may be fitted to the feet 26 and/or the decks 38.

Although not shown, the support structure 8 may comprise mechanical or powered means for facilitating the expansion and retraction of the support structure 8 from its nested condition. The facilitating means may be integrated within the interface 32 between the support means 24 and the apex 22 of the A-frame beneath. Alternatively, the powered means may be integrated with the lower portion 18 of the or each limb 16 of each A-frame 10,12, interfacing with the foot 26 of the A-frame 10 to guide the movement of the A-frame 12 during extension and retraction of the support structure 8.

Figure 3:
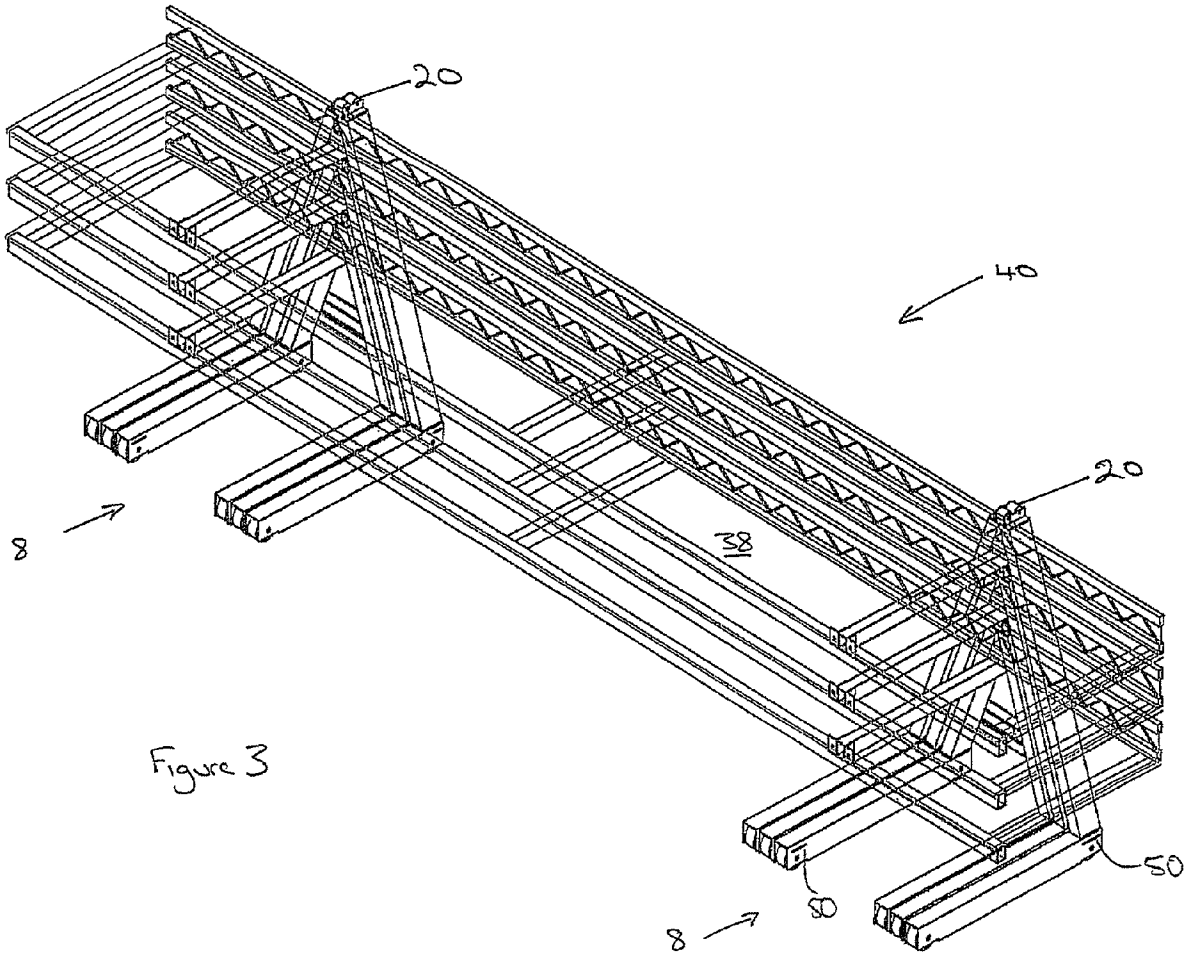
FIG. 3 is a perspective view of a rostrum comprising two of the support structures shown in FIG. 1, in a retracted and nested condition, with a single deck resting on each of the support structures.

Referring to FIG. 3, two support structures 8 are shown displaced at a predetermined distance apart from one another. A deck 38, or similar platform, is arranged upon each of the same-height corresponding support means 24 of each of the A-frames 10,12 to form a rostrum 40. In practice, the rostrum 40 would be assembled in location by positioning each support structure 8 in place, locating a deck 38 upon each pair of same-height support means 24 and extending each of the support structures 8 into their extended position.

The deck 38, arranged upon each of the support means 24 may comprise either a single deck 38 or may alternatively comprise a number of individual decks 38 (not shown). Each deck 38 component is typically secured to the support means 24 by means of conventional nut and bolt type arrangement. There are, however, a number of ways, well known to the person skilled in the art, in which the deck 38 can be attached to the support means.

Figure 4:
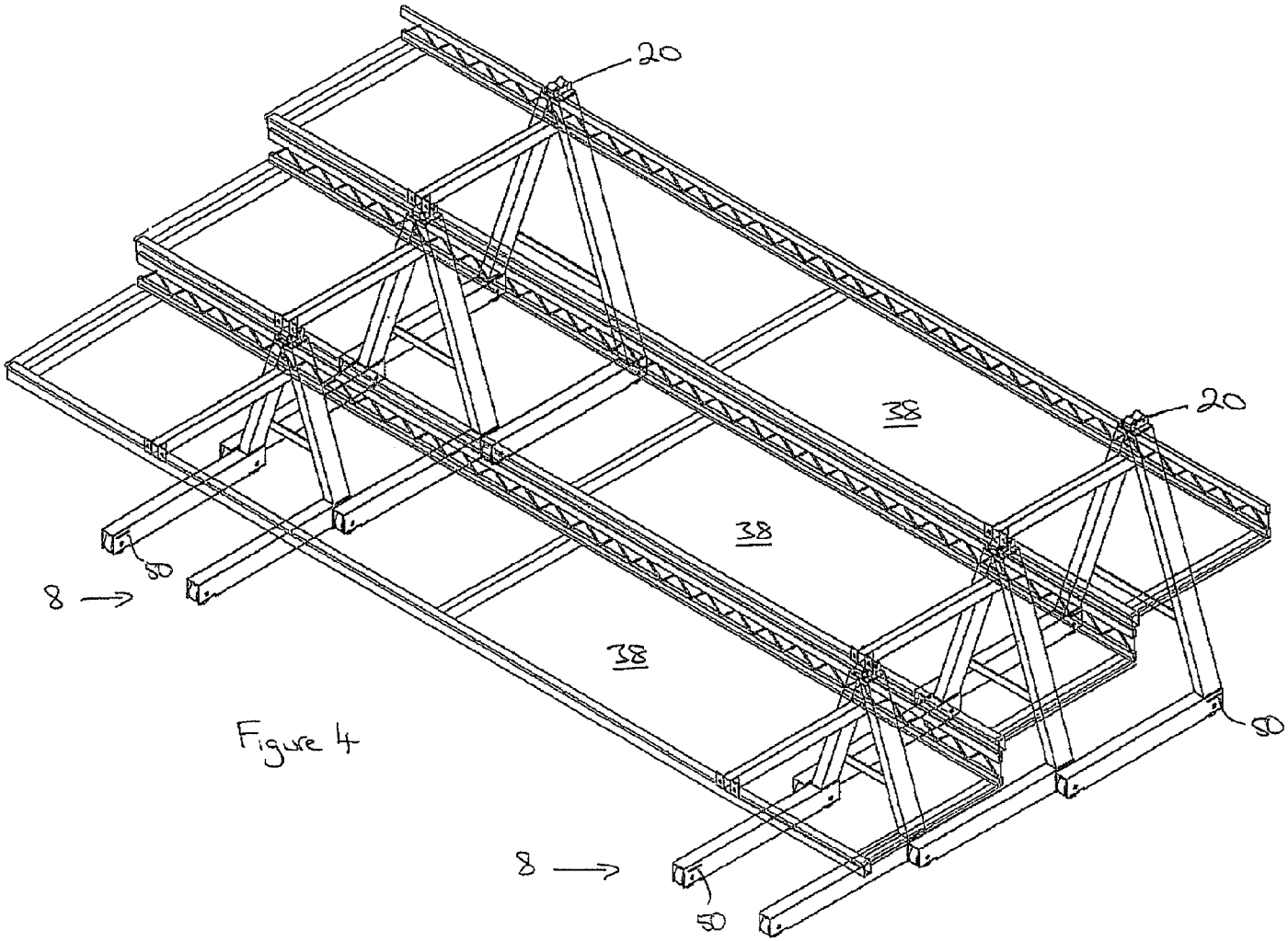
FIG. 4 is a perspective view of the rostrum shown in FIG. 3, in an extended position.

FIG. 4 shows the rostrum 40 assembly of FIG. 3 in an expanded, in use, position. Each of the support structures 8 are shown in an extended position, and a deck 38 is shown resting upon each of the support means 24 to create a tiered rostrum 40.

In an alternative embodiment, the support structure 8 comprises only two upright limbs 16 with a foot 26 extending from the lower portion 18 of each limb 16. Without the support means, the spatial relationship between each of the A-frames 10,12 in the extended position is controlled by the relationship between the lower portion 18 of each limb 16 and the distal end of each foot 26 of the A-frame above. In this embodiment the deck 38 is configured to rest upon the apex 22 of each of the A-frames 10,12, without requiring a support means.

In another alternative embodiment, the support structure 8 comprises only two upright limbs 16, and support means, without any feet 26. In this embodiment, the support structure 8 becomes self-supporting when at least one of the A-frames 10,12 is extended from the nested support structure 8, and the spatial relationship between each of the A-frames 10,12 in the extended position is determined by the relationship between the distal end of the support means 24 and the apex 22 of the A-frame beneath. In use, the interface 32 between the support means 24 and the apex 22 of the A-frame beneath, provide the rigidity of the support structure 8 in its extended position.

In a further embodiment, at least two support structures 8 are provided such that a curved deck 38 (not shown) may be placed thereupon.

In light of the aforementioned description, the support structure 8 may be configured such that when an A-frame is drawn out from beneath the A-frame immediately above, the extent to which each A-frame slides out is dictated by an interface 32 between the apex 22 of the A-frame 10 and the end point 34 of each support means. Alternatively, interacting stops may be arranged upon the vertical faces of each foot 26.

By way of example, the A-frame 10 is connected comprises a support means, which does not have an interface 32 with another A-frame. Instead, the primary, A-frame 10 connects the apex 22 of the A-frame immediately beneath it via an interface 32 to the support means 24 of the A-frame 12. Therefore, each of the A-frames 12, comprising a support means, will be drawn out from the open area beneath the A-frame 10 until the end of the support means 24 of the A-frame 12 reaches the apex 22 of the A-frame immediately above.

In view of these and other variants within the inventive concept, reference should be made to the appended claims rather than the foregoing specific description in determining the inventive concept.

What is claimed is:

1. A rostrum comprising at least two support structures, each support structure comprising:

a first A-frame including an upper portion; and at least two second A-frames, each second A-frame of the at least two second A-frames including an upper portion, the at least two second A-frames configured to be nested and to be retracted into the first A-frame, a respective support connected to each of the first A-frame and configured to support a load;

wherein each of the support structures is configured to telescope and thereby to slidably expand and retract between an extended, in use position and a retracted, stored position such that the at least two second A-frames are slidably received within the first A-frame, and the at least two second A-frames and the first A-frame are held in slidable engagement to expand and retract between the extended and retracted positions such that when the support structures are extended from the retracted position the support structures together are configured to support a deck upon the A-frames and wherein each support is connected to the upper portion of the respective first A-frame, each support having a longitudinal extent extending from the upper portion of the respective first A-frame and comprising a stop positioned at a distal end of each support and configured to secure to a respective second A-frame, each support thus configured to prevent the respective second A-frame from being moved beyond the distal end of the support.

2. A rostrum as claimed in claim 1, wherein in each support structure the first A-frame has an open central area underneath the upper portion of the first A-frame, and each second A-frame has an open central area underneath the upper portion of that second A-frame, such that the open central area of that second A-frame has a shape substantially the same as, but smaller than, the open central area of the first A-frame.

3. A rostrum as claimed in claim 1, wherein in each support structure, the support extends from the upper portion of the first A-frame and is configured to be co-operable with the upper portion of one of the at least two second A-frames.

4. A rostrum as claimed in claim 1, wherein in each support structure each A-frame further comprises:

at least one limb connected to the upper portion; and a linearly extending foot connected to the at least one limb and configured to support the A-frame in an upright position.

5. A rostrum as claimed in claim 1, further comprising a curved deck, wherein the at least two of the support structures are positioned and configured to support the curved deck.

6. A rostrum as claimed in claim 3, wherein in each support structure each A-frame comprises:

at least two limbs connected to the upper portion of the respective A-frame, the first limb and the second limb having a longitudinal extent lying in a plane transverse to the support; and a first foot and a second foot connected, respectively, to the first limb and to the second limb, the first foot and the second foot being parallel to the support, wherein in a retracted, storing position of each second A-frame, each second A-frame is nested in the first A-frame such that the first foot and the second foot of each second A-frame lie between the first foot and the second foot of the first A-frame.

7. A rostrum as claimed in claim 1, wherein in each support structure each A-frame comprises:

a first limb connected to the upper portion and terminating at a first lower portion, and a second limb connected to the upper portion and terminating at a second lower portion, such that the first limb together with the second limb define an open central area underneath the upper portion;

a first foot connected to the first lower portion; and a second foot connected to the second lower portion, the second foot being parallel to the first foot, the first foot and the second foot together configured to support the A-frame in an upright position, wherein the first foot and the second foot of each second A-frame are configured to be nested and to be retracted between the first foot and the second foot of the first A-frame.

8. A rostrum as claimed in claim 1, wherein in each support structure each second A-frame is slidably mounted with respect to the first A-frame, each second A-frame being slidable between a retracted, stored position in which each second A-frame is nested and retracted into the first A-frame, and a second, extended position in which each second A-frame is displaced with respect to the first A-frame.

9. A rostrum as claimed in claim 8, wherein in each support structure the first A-frame has an open central area and each second A-frame has an open central area of a shape substantially the same as, but smaller than, the open central area of the first A-frame.

10. A rostrum according to claim 9, wherein each support structure the support extends from the upper portion of the first A-frame and is configured to be co-operable with the upper portion of one of the at least two second A-frames, wherein an interface between an apex of the upper portion of that second A-frame and an end point of the at least one support dictates an extent to which that second A-frame slides with respect to the first A-frame.

11. A rostrum as claimed in claim 8, wherein in each support structure the first A-frame and each second A-frame each comprise at least one limb having a lower portion; and the first A-frame comprises a foot positioned at the lower portion of the at least one limb of the first A-frame, the foot comprising a inner face;

each second A-frame comprises a foot positioned at the lower portion of the at least one limb of the second A-frame, the foot comprising an outer face, and each foot being positioned and configured to support in an upright position, respectively, the first A-frame and each second A-frame, wherein the foot of each second A-frame is nestable and retractable with respect to the foot of the first A-frame;

wherein each support structure further comprises interacting stops positioned on the outer face of the foot of each second A-frame and the inner face of the foot of the first A-frame, such that the interacting stops cooperate with each other to determine an extent to which each second A-frame slides distally with respect to the first A-frame.

12. A rostrum, comprising at least two support structures, each support structure comprising:

a first A-frame including an upper portion; and at least a second A-frame, including an upper portion, the at least one second A-frame configured to be nested and to be retracted into the first A-frame, wherein each of the support structures is configured to telescope and thereby to expand and retract between an extended, in use position and a retracted, stored position such that when the support structures are extended from the retracted position the support structures together are configured to support a deck upon the A-frames, further comprising a respective support connected to each of the first A-frames and configured to support a load, wherein each support is connected to the upper portion of the respective first A-frame, each support having a longitudinal extent extending from the upper portion of the respective first A-frame and comprising a stop positioned at a distal end of each support and configured to secure to a respective second A-frame, each support thus configured to prevent the respective second A-frame from being moved beyond the distal end of the support.

13. A rostrum comprising at least two support structures, each support structure comprising:

a first A-frame including an upper portion; and at least one second A-frame, the at least one second A-frame including an upper portion and configured to be nested and to be retracted into the first A-frame, further comprising at least one support connected to each A-frame and configured to support a load, wherein the at least one support is connected to the upper portion of the first A-frame, the at least one support extending from the upper portion of the first A-frame and configured to be co-operable with the upper portion of the second A-frame, wherein each A-frame comprises:

at least two limbs connected to the upper portion of the respective A-frame, the first limb and the second limb having a longitudinal extent lying in a plane transverse to the at least one support; and a first foot and a second foot connected, respectively, to the first limb and to the second limb, the first foot and the second foot being parallel to the at least one support, wherein in a retracted, storing position of the second A-frame, the second A-frame is nested in the first A-frame such that the first foot and the second foot of the second A-frame lie between the first foot and the second foot of the first A-frame.

14. A rostrum comprising at least two support structures, each support structure comprising:

a first A-frame including an upper portion; and at least one second A-frame, the at least one second A-frame including an upper portion and configured to be nested and to be retracted into the first A-frame, wherein each A-frame comprises:

a first limb connected to the upper portion and terminating at a first lower portion, and a second limb connected to the upper portion and terminating at a second lower portion, such that the first limb together with the second limb define an open central area underneath the upper portion;

a first foot connected to the first lower portion; and a second foot connected to the second lower portion, the second foot being parallel to the first foot, the first foot and the second foot together configured to support the A-frame in an upright position, wherein the first foot and the second foot of the second A-frame are configured to be nested and to be retracted between the first foot and the second foot of the first A-frame.

* * * * *

UNITED STATES PATENT AND TRADEMARK OFFICE

CERTIFICATE OF CORRECTION

PATENT NO. : 8,640,388 B2
APPLICATION NO. : 12/663588
DATED : February 4, 2014
INVENTOR(S) : Giles Favell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 258 days.

Signed and Sealed this
Twenty-second Day of September, 2015

Michelle K. Lee

Michelle K. Lee
*Director of the United States Patent and Trademark Office*